United States Patent [19]

Klip

[11] 4,004,359

[45] Jan. 25, 1977

[54] MOUTHPIECE FOR A SUCTION DREDGER

[75] Inventor: Johan Klip, Berkenwoude, Netherlands

[73] Assignees: Konijn Machinebouw B.V.; Bagger-En Constructiebedrijf Johan Klip B.V., both of Netherlands

[22] Filed: May 8, 1975

[21] Appl. No.: 575,961

[30] Foreign Application Priority Data

May 22, 1974 Netherlands ..... 7406867

[52] U.S. Cl. ..... 37/66; 37/57

[51] Int. Cl.[2] ..... E02F 3/88

[58] Field of Search ..... 37/54, 57, 58, 59, 62–68, 37/77, 43 D, 43 E, 108 R

[56] References Cited

UNITED STATES PATENTS

| | | | |
|---|---|---|---|
| 532,183 | 1/1895 | Pike | 37/58 |
| 1,038,049 | 9/1912 | Van Wienen | 37/58 |
| 1,169,745 | 1/1916 | Haddon | 37/57 X |
| 2,125,740 | 8/1938 | Schacht | 37/57 X |
| 2,627,155 | 2/1953 | Shuler, Jr. et al. | 37/43 D |
| 2,830,389 | 4/1958 | Simpson | 37/58 |
| 3,171,220 | 3/1965 | Schram | 37/66 |
| 3,429,062 | 2/1969 | Nelson | 37/57 |
| 3,479,755 | 11/1969 | Schropp | 37/8 |

FOREIGN PATENTS OR APPLICATIONS

| | | | |
|---|---|---|---|
| 44,535 | 10/1888 | Germany | 37/66 |

*Primary Examiner*—E. H. Eickholt

[57] ABSTRACT

A mouthpiece for a suction dredger comprising an inlet section open on the underside and having sides which converge rearwardly towards a comminuting section which is also open on its underside. A shaft is rotatably mounted in the comminuting section and is provided with a plurality of comminuting members which include at least one cutting blade. A suction section is positioned rearwardly of the comminuting section and is provided with a connection, which, in use, is coupled to the dredger suction line.

16 Claims, 4 Drawing Figures

MOUTHPIECE FOR A SUCTION DREDGER

BACKGROUND OF THE INVENTION

The invention relates to a mouthpiece for a suction dredger, which is adapted to be connected via a suction line to the suction side of a pump and moved by the dredger under water in an approximately horizontal direction.

SUMMARY OF THE INVENTION

An object of the invention is to provide such a mouthpiece for suction dredgers which has a very high input capacity, on the one hand, and is adapted, on the other hand, to collect and treat coarse dredged material, including such material containing bulky vegetation or parts of plants.

A mouthpiece for suction dredgers according to the invention is characterized by an inlet section forwardly situated in the direction of travel, which is open on the underside and which has two rearwardly converging, upwardly extending side plates; a comminuting section connected at the rear of the inlet section and also open on the underside, said comminuting section having an upper cover plate and two side plates, in which latter plates is journalled an approximately horizontal positively driven cutter shaft, on which are mounted a plurality of comminuting members each of which includes at least one cutting blade and which are uniformly spaced and mutually angularly staggered; and a suction section connected at the rear of the comminuting section and provided with a connection which, in use, is coupled to the dredger suction line, said suction section being completely enclosed between the connections to the comminuting section and the dredger suction line.

The effect achieved by such a construction is that the two widely spaced and rearwardly converging side plates at the inlet section pick up the dredged material and constrict it so that the sullage in said material are compacted thus increasing the handling capacity of the suction mouthpiece.

The inlet section preferably includes a cover plate which, in the operating position, slopes forwardly and upwardly and is adapted to be connected and fastened to the side plates of the inlet section.

In their passage through the comminuting section, the bulky sullage in the dredged material, such as for example, solid peat lumps and loam or clay including baked clay material such as roofing tiles and clinker, are comminuted by the rapidly rotating cutting blades, while the pieces of plant material and vegetation are separated and minced up. Other large solid lumps in the dredged material, which cannot be comminuted by the cutting blades are ejected downwardly by said blades from the comminuting section. By this means any blocking up of the suction line is substantially avoided.

In a preferred embodiment of the invention the cutting blades of the comminuting members are twisted. Thereby, the comminuting effect of the cutting blades is substantially intensified, on the one hand, whereas, on the other hand, this twisting produces further compression of the solids in the dredged material, resulting in a still further increase in the solids content in the dredged material. This inevitably results in an increase in the input and handling capacity of the suction mouthpiece according to the invention.

In order further to facilitate the rejection of very bulky solids in the dredged material from the comminuting section, according to a further feature of the invention, a guard cage is provided for the comminuting section, which consists of parallel guard rods running obliquely rearwardly and downwardly from the leading edge of the cover plate of the comminuting section between the comminuting members and in planes intersecting the cutter shaft at right angles, the bottom ends of said rods being joined to the leading edge of the bottom wall of the suction section and lying, when in the operating position, at least approximately in the horizontal plane passing through said leading edge.

BRIEF DESCRIPTION OF THE DRAWINGS

Further particularities and features of the invention will be apparent from the following description of a preferred embodiment with reference to the accompanying drawings; in said drawings.

DESCRIPTION OF A PREFERRED EMBODIMENT

Figure 1:
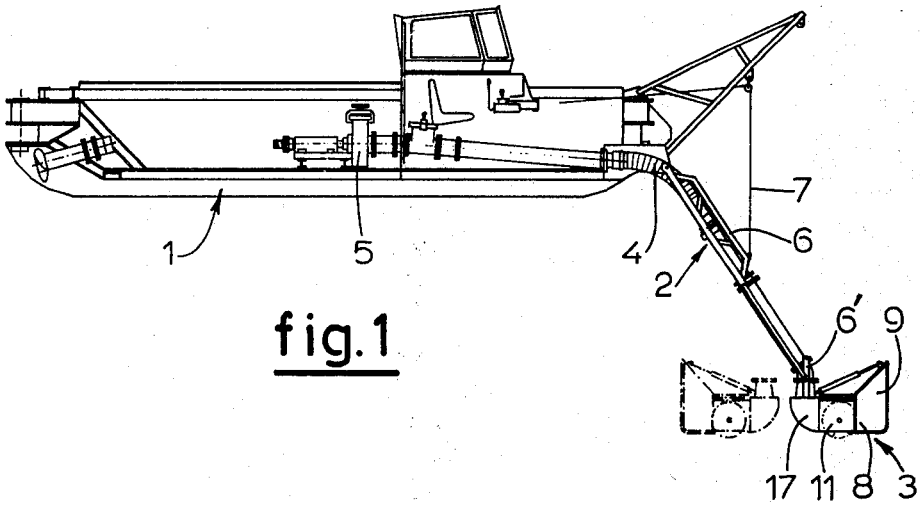
FIG. 1 is a diagrammatic longitudinal section through a dredger having a suction mouthpiece, according to the invention, at the outer end of its suction line.

The dredger 1 illustrated in FIG. 1 is equipped with suction dredging equipment 2 having a suction mouthpiece 3, according to the invention at its lower end. This suction mouthpiece 3 is connected via the suction line 4 to the suction side of a dredging pump 5 and is suspended from dredger 1 by means of a supporting frame 6 connected to supporting straps 6' and mouthpiece 3 may be raised or lowered by means of the hawser 7. The mouthpiece 3 is caused by the dredger 1 to move over and through the mud in an at least approximately a horizontal direction. Consequently, it can be moved directly over the bed of a waterway or, if need be, it can be moved at any desired height through the water above the bed. As is shown in FIG. 1, the suction mouthpiece 3 can be both pushed forwardly (as shown in full lines), and also towed forwardly, as is shown in broken lines.

The suction mouthpiece 3 includes an inlet section 8 positioned in front in the direction of movement, which consists of two side plates 9 which diverge in the direction of movement, i.e. are therefore rearwardly converging, and a cover plate 10 sloping forwardly and upwardly in the operating position, said cover plate being connected to the side plates 9. The inlet section 8 is open on the underside.

A comminuting section 11 which is likewise open on the underside is connected to the rear of the inlet section 8. The comminuting section includes a cover plate 12 to which the cover plate 10 of the inlet section 8 is fastened, and two vertical side plates 13 connected with the side plates 9 of the inlet section.

A cutter shaft 14, which is connected to a hydraulic motor 15, is mounted, in an at least approximately horizontal working position transversely to the direction of travel, in the side plates 13. Comminuting members 16 are mounted in preferably uniform spacing on the cutter shaft 14. The comminuting members 16 are also mutually staggered angularly, in order to achieve as uniform, as possible, a degree of engagement of the cutting blades with the solids in the dredged material so as to avoid shocks. The blades of the comminuting member 16 are twisted, so that their comminuting efficiency is improved. These cutter blades are twisted in such a way that lateral thrust is exerted on the solids in the dredged material. By this means, the compression of the solids in the dredged material, which has already been increased by the positioning of the side plates 9 and of the cover plate 10 of the inlet section, is further intensified, so that the suction mouthpiece 3 provides a very high take-up and handling capacity.

In the embodiment shown in the drawings, each comminuting member 16 mounted on the cutter shaft 14 has four cutter blades, which have a mutual angular spacing of 90°.

A suction section 17 is connected to the rear of the comminuting section 11. This suction section includes a cover plate 18 on which is fabricated a connection 19 which is adapted to be coupled to the suction line 4. The suction section 17 includes a rear and bottom wall 20, shown curved in the drawing, in which an inspection flap 21 is provided, which flap is hinged about a lower hinge 22 and can be locked when closed by fastening means 23. Apart from the connections to the comminuting section 11 and the suction line 4 the suction section 17 is completely enclosed.

Figure 2:
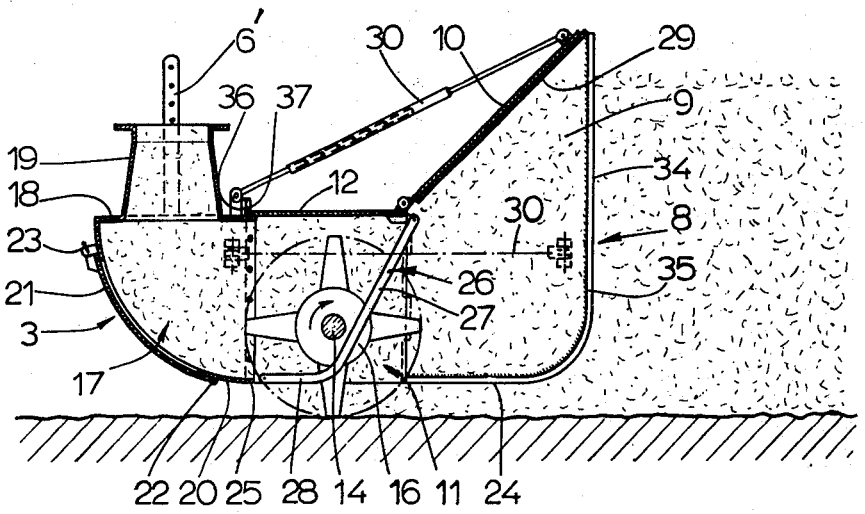
FIG. 2 is a longitudinal section on an enlarged scale of the suction mouthpiece of FIG. 1.
Figure 3:
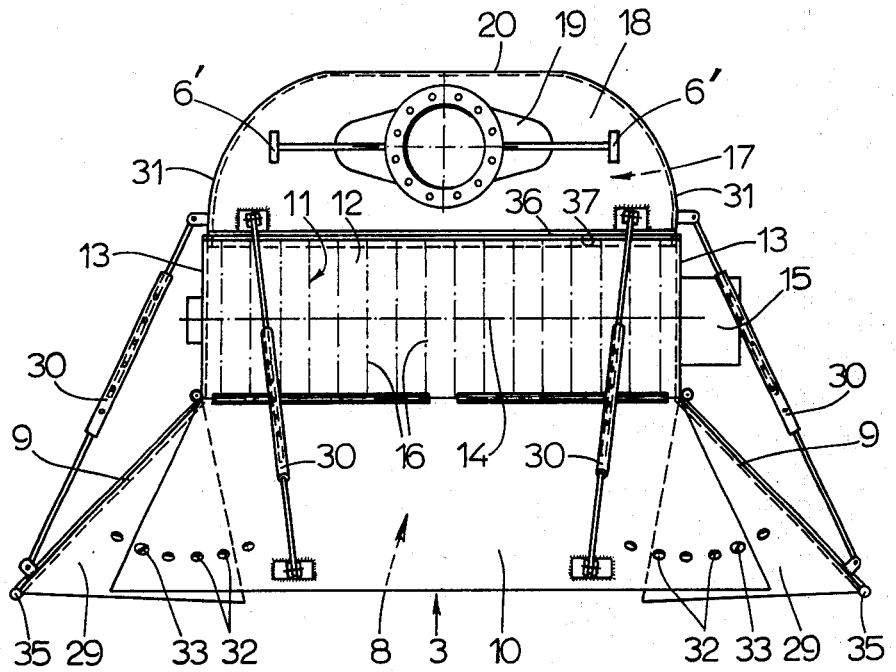
FIG. 3 is a plan view of the suction mouthpiece of FIG. 2.
Figure 4:
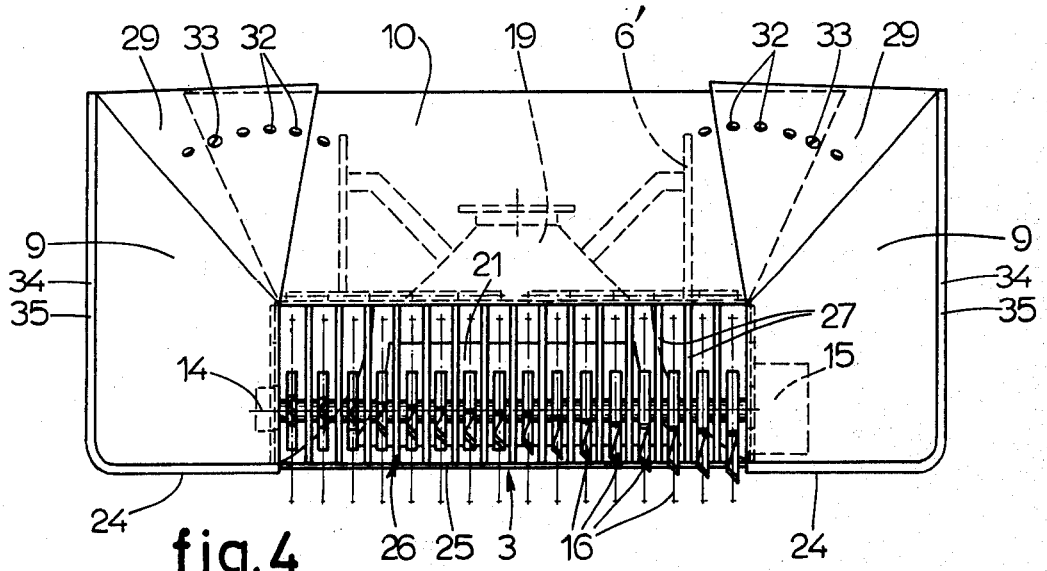
FIG. 4 is a front view of the suction mouthpiece of FIG. 2, i.e. as seen from the input end.

As shown especially in FIG. 2, the cutting blades of the comminuting member 16 protrude when in a downwardly pointing direction beyond the bottom edges 24 of the side plates 9 and beyond the leading edge 25 of the bottom and rear wall 20 of the suction section 17. Thereby, an effect is obtained in that the cutting blades, which are set in rotation in the direction of the arrow shown in FIG. 2, expel downwardly through the open bottom side of the comminuting section 11 bulky solid constituents in the dredged material which cannot be comminuted. In the embodiment illustrated in the drawing, the lower edges 24 of the side plates 9 and the leading edge 25 lie in a horizontal plane in the operating position.

A removable guard cage 26 is also mounted on the comminuting section 11, which prevents bulky solid lumps in the dredged material, which might block the suction line 4 or the dredger pump 5, from entering the suction section. This guard cage 26 consists of a number of parallel guard rods 27 disposed in vertical planes in the operating position, which rods are connected to the cover plate 12 of the comminuting section 11 in the region of the leading edge thereof and which can obliquely rearwardly and downwardly between the individual comminuting members 16. As is shown in FIG. 2, these guard rods 27 extend closely in front of but spaced from the cutter shaft 14. The lower ends 28 of the guard rods 27, which in the operating position extend at least approximately within the horizontal plane through the lower edges 24 of the side plates 9 and the leading edge 25 of the rear and bottom wall 20 of the suction section 17, are connected to the aforesaid leading edge 25. In so doing these lower ends 28 of the guard rods 27 extend approximately across the rear half of the comminuting section 11 and prevent any large solid lumps from getting into the suction section 17 through the action of the upwardly moving cutting blades in this region. The side plates 9 of the inlet section 8 are pivotably connected, by means of an aproximately vertical pivotable axle to the side plates 13 of the comminuting section 11 and can be fixed in different angular positions. The upper edges thereof are provided with bent connecting wings 29, adapted to be fixed to the cover plate 10, while said cover plate 10 itself is pivotably connected, by means of an approximately horizontal pivotable axle to the cover plate 12 of the comminuting section 11.

In order to be able to fix the side plates 9 and the cover plate 10 of the inlet section in any desired position, connecting rods 30 serving as supports are pivotably connected thereto, the length of said rods being adjustable as desired. These connecting rods 30 may be constructed, for example, as collapsible and extendible telescopic rods, the individual rod members having a number of perforations adapted to register with one another so that with the aid of pegs pushed therethrough the rods may be adjusted to any desired length. The other ends of these connecting rods 30 are pivotably connected to the side walls 31 or the cover plate 18 of the suction section 17.

The bent connecting wings 29 of the side plates 9 and the cover plate 10 of the inlet section are each provided with a suitably arranged series of apertures 32, registering pairs of which correspond to the adjustable length of the connecting rods 30, so that a rigid connection between the side plates and the cover plate can be established by means of bolts 33.

Advantageously, the leading edges 34 and the lower edges 24 of the side plates 9 are stiffened by a rod 35 which is preferably welded thereto.

In the illustrated embodiment the leading edge of the cover plate 18 of the suction section 17 is formed with a flange 36, said flange being connected to a mating flange 37 on the rear edge of the cover plate 12 of the comminuting section 11 by means of bolts (not shown). The side plates 31 of the suction section 17 overlap the side plates 13 of the comminuting section 11 and are connected thereto by means of bolts (not shown).

The uptake and handling or output capacity of the above-described mouthpiece 3 into a suction dredger device 2 is very large due principally to the fact that solids present in the dredged material are compressed by the special construction of said mouthpiece. Moreover, portions of plants and vegetation are separated and chopped up, very large solid lumps being comminuted by the cutting blades of the comminuting members 16 as far as possible or are ejected from this suction mouthpiece 3 before reaching the suction section 17, s that the suction line 4 or the dredging pump 5 is reliably prevented from becoming stopped up.

The invention is not restricted to the embodiment shown in the drawing, which can be varied in within the scope of the appended claims.

I claim:

1. A mouthpiece for a suction dredger, which is adapted to be connected via a suction line to the suction side of a pump and moved by the dredger under water in an approximately horizontal direction, said mouthpiece comprising an inlet section forwardly situated in the direction of travel, which is open on the underside and which has two rearwardly converging, upwardly extending side plates; a comminuting section connected at the rear of the inlet section and also open on the underside, said comminuting section having an upper cover plate and two side plates, an approximately horizontal positively driven cutter shaft journalled in said side plates, a plurality of comminuting members mounted on said shaft each including at least one cutting blade, the blades being uniformly spaced and mutually angularly staggered on said shaft; and a suction section connected at the rear of the comminuting section and provided with a connection which, in use, is coupled to the dredger suction line, said suction section being completely enclosed between the connections to the comminuting section and the dredger suction line, said cutting blades in a downwardly pointing position projecting downwardly beyond the lower edges of the side plates of the inlet section and beyond the leading edge of the bottom wall of the suction section, the lower edges of the side plates of the inlet section and the leading edge of the bottom wall of the suction section in a working position being disposed in a horizontal plane.

2. A mouthpiece according to claim 1, wherein the cutting blades of the comminuting members are twisted.

3. A mouthpiece according to claim 1, comprising a guard cage for the comminuting section, which comprises parallel guard rods running obliquely rearwardly and downwardly from the leading edge of the cover plate of the comminuting section between the comminuting members and in planes intersecting the cutter shaft at right angles, the bottom ends of said rods being joind to the leading edge of the bottom wall of the suction section and lying, when in the operating position, at least aproximately in the horizontal plane passing through said leading edge.

4. A mouthpiece according to claim 3, wherein the guard rods pass in front of at and a small distance from the cutter shaft.

5. A mouthpiece according to claim 3, wherein the lower ends of the guard rods which are approximately horizontal in the operating position, extend across the rear half of the comminuting section.

6. A mouthpiece according to claim 1, wherein each comminuting member has four cutting blades with an angular spacing of 90° between them.

7. A mouthpiece according to claim 1, wherein an hydraulic motor for the drive of the cutter shaft.

8. A mouthpiece according to claim 1, wherein the inlet section includes a cover plate which, in the operating position, slopes forwardly and upwardly and is adapted to be connected and fastened to the side plates of the inlet section.

9. A mouthpiece according to claim 1, wherein the side plates of the inlet section are pivotably connected to the side plates of the comminuting section and are adapted to be fixed in different angular positions.

10. A mouthpiece according to claim 1, wherein the wall of the suction section includes a hinged inspection flap which can be locked in a closed position.

11. A mouthpiece according to claim 1, wherein the connection for the dredger suction plate is fabricated in the cover plate of the suction section.

12. A mouthpiece according to claim 1, wherein the leading edge of the cover plte of the suction section includes a flange adapted to be connected to a mating flange on the rear edge of the cover plate of the comminuting section, while the side plates of the suction section overlap the side plates of the comminuting section and are connected thereto by bolts.

13. A mouthpiece for a suction dredger, which is adapted to be connected via a suction line to the suction side of a pump and moved by the dredger under water in an approximately horizontal direction, said mouthpiece comprising an inlet section forwardly situated in the direction of travel, which is open on the underside and which has two rearwardly converging, upwardly extending side plates; a comminuting section connected at the rear of the inlet section and also open on the underside, said comminuting section having an upper cover plate and two side plates, an approximately horizontal positively driven cutter shaft journalled in said side plates, a plurality of comminuting members mounted on said shaft each including at least one cutting blade, the blades being uniformly spaced and mutually angularly staggered on said shaft; and a suction section connected at the rear of the comminuting section and provided with a connection which, in use, is coupled to the dredger suction line, said suction section being completely enclosed between the connections to the comminuting section and the dredger suction line, said side plates of the inlet section being pivotably connected to the side plates of the comminuting section and adapted to be fixed in different angular positions and bent connecting wings on the upper edges of the side plates of the inlet section fixed to the cover plate of the inlet section.

14. A mouthpiece according to claim 13, wherein the cover plate of the inlet section is pivotably connected to the cover plate of the comminuting section.

15. A mouthpiece according to claim 14, comprising lengthwise adjustable connecting rods pivotably connected to the side plates and the cover plate of the inlet section, the other ends of said rods being pivotably connected to the side plates or the cover plate of the comminuting section or of the suction section, and wherein the connecting wings of the side plates and the cover plate of the inlet section include a row of pairs of holes which when in register correspond to the adjustable lengths of the connecting rods, so that a rigid connection between the side plates and the cover plate can be established by inserting threaded bolts through said holes.

16. A mouthpiece for a suction dredger, which is adapted to be connected via a suction line to the suction side of a pump and moved by the dredger under water in an approximately horizontal direction, said mouthpiece comprising an inlet section forwardly situated in the direction of travel, which is open on the underside and which has two rearwardly converging, upwardly extending side plates; a comminuting section connected at the rear of the inlet section and also open on the underside, said comminuting section having an upper cover plate and two side plates, an approximately horizontal positively driven cutter shaft journalled in said side plates, a plurality of comminuting members mounted on said shaft each including at least one cutting blade, the blades being uniformly spaced and mutually angularly staggered on said shaft; and a suction section connected at the rear of the comminuting section and provided with a connection which, in use, is coupled to the dredger suction line, said suction section being completely enclosed between the connections to the comminuting section and the dredger suction line, and rods welded to the leading edge and the bottom edges of said side plates of the inlet sections for stiffening the same.

* * * * *